United States Patent [19]

Robertson

[11] 4,303,970

[45] Dec. 1, 1981

[54] BATTERY POWERED LAMP

[76] Inventor: James H. Robertson, 6502 Agnes Ave., North Hollywood, Calif. 91606

[21] Appl. No.: 157,419

[22] Filed: Jun. 9, 1980

[51] Int. Cl.[3] ..... F21L 7/00

[52] U.S. Cl. ..... 362/203; 362/206; 362/186

[58] Field of Search ..... 362/203, 206, 186

[56] References Cited

U.S. PATENT DOCUMENTS 4,220,985 9/1980 Hukuba ..... 362/203

*Primary Examiner*—Stephen J. Lechert, Jr.

[57] ABSTRACT

A novel battery powered lamp is disclosed which includes a hollow housing, a light bulb disposed in the housing for external illumination, a battery in the housing and switch means. In one embodiment, the switch means is a rotary switch having a manually rotatable arm extending through the housing, preferably at the rear end, for movement into and out of contact with a contact plate. In another embodiment, a flexible resilient electrically insulative biasing block is interposed between the bulb and battery and bears contacts. The block preferably supports the bulb while biasing the contacts in place against the bulb and battery. In a third embodiment, the bulb is socketless and has its base embedded in the block so that it is suspended in a transparent portion of the housing. Each embodiment is simple to assemble and use, inexpensive to make and maintain, efficient and durable. All are utilizable as portable flashlights and the like, and are capable of being made weatherproof.

20 Claims, 8 Drawing Figures

BATTERY POWERED LAMP

BACKGROUND OF THE INVENTION

1. Field of the Invention

The present invention generally relates to illuminating means and more particularly, to an electrical lamp of an improved type.

2. Prior Art

The usual type of flashlight includes a light bulb with socket base, a reflector into which the bulb is screwed, a battery biased into electrical contact with the base of the bulb by a metal spring, and a housing holding the bulb, reflector, battery and spring. A switch is secured to the exterior of the housing and completes a circuit which includes a rear contact with the battery.

Most such conventional devices are too expensive to make in a substantial size for throw-away (one use) purposes where large numbers are required. Yet there is just such a need for large numbers of such flashlights and the like for emergency purposes, such as for illuminating disaster victims at sea, air crach victims, outlining road and bridge blockages, etc. To be useful at sea, the devices should be airtight and non-corrodable. For all emergency purposes, the devices should be simple, and as inexpensive and foolproof as possible. It therefore would be highly desirable to be able to devise simplified inexpensive versions of such lamps for mass production.

SUMMARY OF THE INVENTION

The present invention satisfies all the foregoing needs. Thus, an improved, inexpensive, simple and efficient electrical lamp is provided which is substantially as set forth in the Abstract above. The lamp can utilize, if desired, socketless lamp bulbs, which are less expensive than socketed lamp bulbs. Moreover, instead of utilizing a corrodable, expensive metal spring behind the battery to bias the battery in place directly against the light bulb, an inexpensive electrically insulative resilient biasing block can be disposed between the bulb and battery to force the components into electrical contact. The block itself bears contacts and supports the bulb, rather than depending on a metal bracket or reflector.

The switch utilized with the lamp is preferrably of the rotary type, extending through the housing and moving an arm into and out of contact with a contact plate. The device is easy to manufacture, assemble and disassemble, and can be made largely of plastic, foam rubber, etc., for low cost and no maintenance. Further features of the improved lamp of the present invention are set forth in the following detailed description and accompanying drawings.

DETAILED DESCRIPTION OF THE PREFERRED EMBODIMENT

Figure 1:
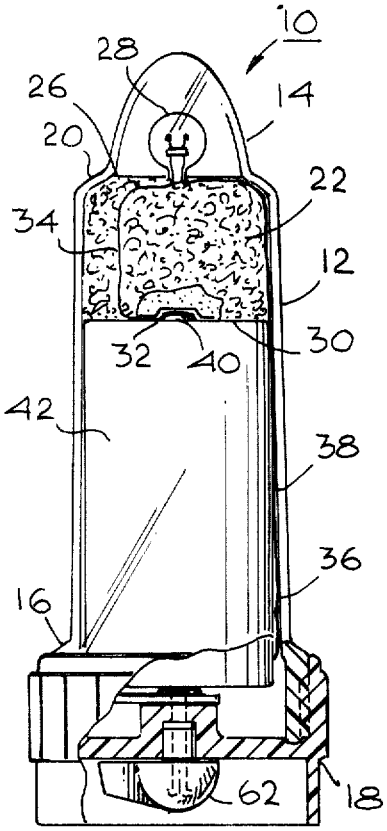
FIG. 1 is a schematic side elevation of a first preferred embodiment of the improved battery powered lamp of the present invention.
Figure 4:
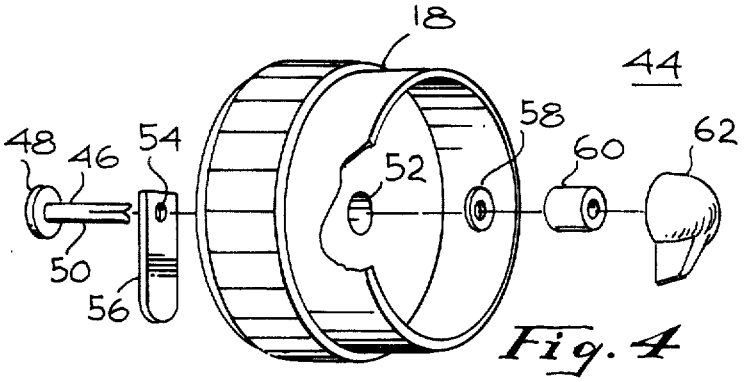
FIG. 4 is an exploded schematic perspective view of the end cap and switch of FIG. 3.
Figure 5:
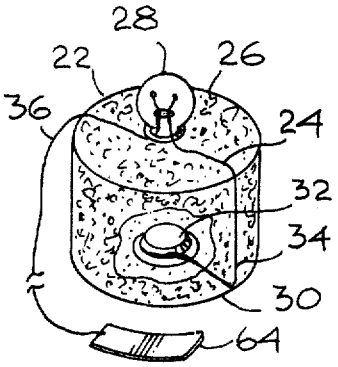
FIG. 5 is a schematic perspective view, partly broken away, of the socketless light bulb and block of the lamp of FIG. 1, together with electrical leads and contacts.
Figure 6:
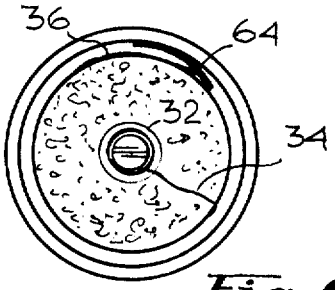
FIG. 6 is a schematic rear end view of the lamp of FIG. 1 with the rear end cap and dry cell removed.
Figure 2:
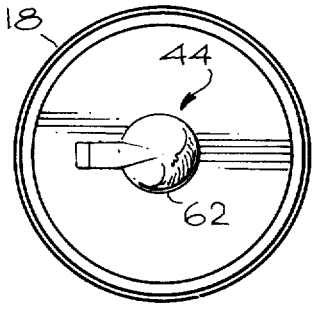
FIG. 2 is a schematic rear end view of the lamp of FIG. 1.
Figure 3:
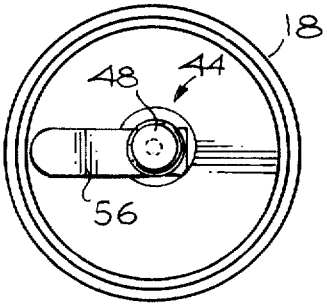
FIG. 3 is a schematic front elevation of the inside of the end cap and switch of the lamp of FIG. 1.

Referring more particularly to FIGS. 1-6 of the drawings, a first preferred embodiment of the improved electrical lamp of the present invention is schematically depicted. Thus, lamp 10 is shown which includes a hollow elongated housing 12, preferrably generally cylindrical and containing a transparent front end 14 and a rear end 16 releasably closed by a removable rear end cap 18. Housing 12 preferrably is of high density plastic, such as polycarbonate, and is preferrably water and moisture tight so that it is useful in a sea environment.

As shown in FIG. 1, housing 12 is of clear plastic and front end 14 is of a reduced diameter so as to provide a slope cylindrical shoulder or rim 20. Rim 20 acts as a stop to prevent a cylindrical block 22 of resilient, flexible, electrically insulative material such as natural or synthetic rubber or the like, for example, sponge rubber, from protruding forward into front end 14. Block 22 has a slit 24 (FIG. 5) across its front end 26 within which is releasably disposed the base of a socketless light bulb 28. Bulb 28 protrudes forward of block 22 and into end 14 for illumination therethrough.

In the center of the rear end 30 of block 22 is secured a cup-shaped metal contact 32 and an electrical wire lead 34 from bulb 28 is secured thereto. Thus, lead 34 extends from bulb 28 along slit 24, down the side of block 22 and along its rear end 30 to contact 32. A second electrical wire lead 36 extends from bulb 28 rearwardly along the inner surface 38 of housing 12 to the rear end 16 thereof. Contact 32 is adapted to receive the button 40 centered on the front end of the dry cell 42 (battery) in housing 12 and representing one pole thereof.

End cap 18 is releasably threadably received on rear end 16 of housing 12 and bears a switch 44. Switch 44 includes (FIG. 4), an elongated metal-headed pin 46, the rounded head 48 of which acts as a contact for the rear end of battery cell 42 and the shaft 50 of which extends rearwardly through a central opening 52 in end cap 18 and an opening 54 in a base contact arm 56.

Arm 56 is secured to pin 46 for rotation therewith inside cap 18. An O-ring 58 and O-collar 60 are disposed around shaft 50 in hole 52 to seal it in place, and a switch handle 62 is secured over the rear end of shaft 50, so that rotation of handle 62 rotates arm 56.

Arm 56 is dimensioned to contact a metal contact plate 64 (FIG. 6) set in the inner periphery of housing 12 at the rear end thereof. Plate 64 is flexible and is flat, only two opposite ends thereof being secured against surface 38 of housing 12, so that contact with arm 56 flexes both plate 64 and arm 56 and helps hold or releasably lock arm 56 against plate 64 in the contact position. Lead line 36 runs to and is connected to plate 64.

Thus, when handle 62 is rotated to cause arm 56 to contact plate 64, the circuit between bulb 28 and dry cell 42 is completed and bulb 28 is powered to emit light through lead 34 to contact 32, button 40 and one pole of cell 42, through the cell 42 casing at its rear end (not shown), head 48, arm 56, plate 64 and lead 36 back to bulb 28.

It will be noted that housing 12, including front end 14, is one piece, and water tight, and that cap 18 is threaded thereon in a water-tight manner. Moreover, switch 44 is sealed in a water-tight manner to cap 18, so that lamp 10 can withstand a sea environment. Since all external components of lamp 10 can be of plastic or the like non-corrodable materials, deterioration in moisture does not occur. Thus, lamp 10 is simple, inexpensive, durable and efficient.

Figure 7:
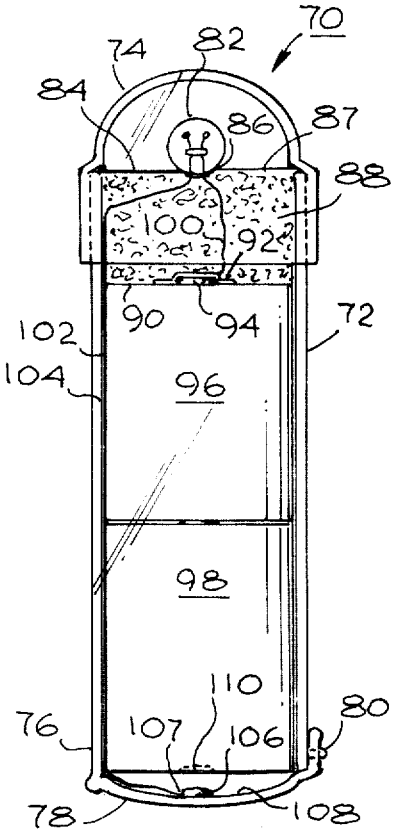
FIG. 7 is a schematic side elevation, partly broken away, of a second preferred embodiment of the improved lamp of the present invention.

A second preferred embodiment of the improved electrical lamp of the present invention is schematically depicted in FIG. 7. Thus, lamp 70 is shown, which comprises a transparent generally cylindrical housing 72 of plastic or the like, having a domed front end 74 threaded thereto and a rear end 76 housing a hinged end cap 78 releasably secured in place, as by a snap button assembly 80, or the like.

A socketless light bulb 82 is disposed in end 74, the base 84 of which is received in a crevice 86 in the front end 87 of a cylindrical block 88 of resilient, flexible thermally insulative material, such as foamed or unfoamed elastomer. End 74 is necked down to prevent block 88 from protruding thereinto. The rear end 90 of block 88 is fitted with a central cup-shaped metal contact 92 adapted to receive the contact button 94 at the front end of dry cell 96.

A second dry cell 98 is disposed behind cell 96. An electrical lead 100 runs from bulb 82 through and/or around block 88 to contact 92 and a second electrical lead 102 runs from bulb 82 through and/or around block 88 and down the under surface 104 and to a metal contact 106 supported on the central portion 107 of the inner surface 108 of end cap 78. It will be noted that cap 78 is curved so that the central portion thereof is spaced rearwardly from the central rear end 110 of cell 98. However, end cap 78 is flexible and the central portion thereof can be flexed forward by finger pressure (as by a thumb) to bring contact 106 against end 110 so as to complete an electrical circuit between cells 96 and 98, and bulb 82 to light bulb 82, causing it to send illumination through front end 74. Release of forward finger pressure on the central portion of cap 78 allows cap 78 to automatically return to the "switch-off" position of FIG. 7 due to the "elastic memory" of the plastic or other material used in cap 78. Lamp 70 can be made water tight and moisture proof, is easily assembled by sliding the components in place, is just as easily disassembled and is inexpensive, suitable for mass production. It is also efficient in use. Block 88 has the dual function of holding bulb 82 while insulating it and leads 100 and 102, and also of biasing cells 96 and 98 in position in housing 72 for easy contact with contacts 92 and 106.

Figure 8:
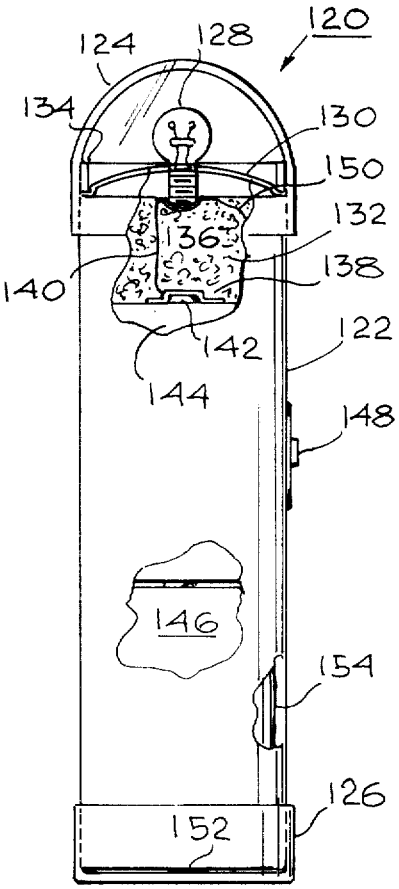
FIG. 8 is a schematic side elevation, partly broken away, of a third preferred embodiment of the improved lamp of the present invention.

A third preferred embodiment of the improved electrical lamp of the present invention is schematically depicted in FIG. 8. Thus lamp 120 is shown, which comprises a hollow cylindrical housing 122 having a domed, threaded, clear plastic front end portion 124, releasably secured thereto and a threaded rear end cap 126, also releasably secured thereto. A socket-based lamp bulb 128 is threadably disposed in end 124 within a reflective cone-shaped holder 130 supported on a flexible, resilient cylindrical block 132 of an elastomer, such as synthetic or natural rubber, in sponge or non-sponge form. A cylindrical shoulder 134 in end 124 prevents holder 130 and block 132 from protruding into end 124 forward of the point indicated in FIG. 8.

A pair of metal dish or cup shaped contacts 136 and 138 are centered on the front and rear ends, respectively, of block 132 and are interconnected by a lead wire 140. Contact 138 receives the button contact 142 on the front end of dry cell 144. A second dry cell 146 is positioned behind cell 144 and held in place by end cap 126 and by the biasing action of block 132. A switch 148 of a conventional type is disposed on the exterior of housing 122. One side of switch 148 is connected to bulb 128 by a lead 150 running to contact 136, while the other side of switch 148 is connected to a contact 152 in the center of end cap 126 by a lead 154.

Thus, lamp 120 utilizes resilient block 132 to force cells 144 and 146 into a close fit with contacts 138 and 152, respectively, while assuring a firm support for lamp bulb 128. Lamp 120 is simple and inexpensive to construct and maintain and can be made both water proof and moisture proof, if desired, for marine use. All components used in housing 122 are easily insertable into and removable from housing 122. Various other features and advantages of lamp 120 and lamps 10 and 70 are as set forth in the foregoing.

Various changes, modifications, alterations and additions can be made in the improved electrical lamp of the present invention and in the components and parameters of said lamp. All such changes, modifications, alterations, and additions as are within the scope of the appended claims form part of the present invention.

I claim:

1. An improved socketless battery powered electrical lamp, said lamp comprising, in combination:

a. a hollow housing having a transparent front end;
b. a socketless light bulb;
c. a flexible resilient electrically insulative biasing block releasably supporting said light bulb in said transparent end;
d. a battery in said housing behind said block;
e. an end cap releasably secured to the rear end of said housing;
f. a rotary switch extending through said rear end cap;
g. first electrical contact means disposed on the rear end of said block;
h. second electrical contact means disposed in said housing in the path of said switch; and
i. separate leads from said lamp bulb to said first and second contact means, whereby said switch can be rotated to complete an electrical circuit between opposite poles of said battery and said light bulb to power said light bulb.

2. The improved lamp of claim 1 wherein said battery is a dry cell and wherein said first electrical contact means comprises a metal receptacle.

3. The improved lamp of claim 2 wherein said lamp is sealed against entry of water into said housing and wherein said block comprises an elastomer.

4. The improved lamp of claim 3 wherein the base of said light bulb is disposed in a crevice in the front end of said block, and wherein said block comprises sponge rubber.

5. The improved lamp of claim 3 wherein said switch includes a metallic contact arm rotatable into and out of contact with said metal plate and a contact button, and wherein said block biases the rear end of said battery into contact with said button.

6. An improved battery powered electrical lamp, said lamp comprising, in combination:

a. a hollow housing;

b. a light bulb disposed in said housing for light emission therefrom;

c. a flexible, resilient, electrically insulative biasing block disposed behind said light bulb;

d. a battery in said housing behind said block;

e. a rear end cap releasably securing said battery in said housing;

f. electrical contact means extending from said lamp bulb to the rear end of said block for contact by the front end of said battery;

g. switch means on said housing; and h. electrical lead means extending between said switch means, said bulb and the rear end of said battery, said block biasing said battery against said rear end cap.

7. The improved lamp of claim 6 wherein said block supports said bulb.

8. The improved lamp of claim 6 wherein said rear end cap contains said switch means.

9. The improved lamp of claim 8 wherein said switch means comprises a contact disposed on the inner surface of said cap and wherein said cap is resiliently deformable by finger pressure into a closed switch position.

10. The improved lamp of claim 6 wherein said block comprises an elastomer.

11. The improved lamp of claim 10 wherein said elastomer comprises sponge rubber.

12. The improved lamp of claim 6 wherein said light bulb is a socketed light bulb threaded into a holder supported by said block.

13. The improved lamp of claim 6 wherein said light bulb is a socketless light bulb disposed in a pocket in said block.

14. An improved battery powered electrical lamp, said lamp comprising in combination:

a. a hollow housing;

b. a light bulb disposed in said housing;

c. a battery in said housing disposed behind said light bulb;

d. a first contact means running from said lamp to one pole of said battery;

e. second contact means running from said lamp to a point adjacent the opposite pole of said battery; and f. a rotary switch disposed in the circuit between said lamp and battery, said rotary switch comprising a rotatable metal contact arm and a metal contact button, said button contacting said opposite pole of said battery while said arm is rotated into and out of contact with said second contact means.

15. The improved lamp of claim 14 wherein said housing includes a removable rear end cap and wherein said switch is disposed through said cap.

16. The improved lamp of claim 15 wherein said second contact means comprises a metal plate disposed on the inner surface of said housing adjacent said switch and a lead from said plate to said bulb.

17. The improved lamp of claim 16 wherein said battery is a dry cell with one pole at the front end thereof and the opposite pole contact point at the rear end thereof.

18. The improved lamp of claim 17 wherein said arm extends rearwardly of said cap and terminates in a turn handle.

19. The improved lamp of claim 16 wherein said plate flexes when contacted by said contact arm to facilitate maintaining contact therebetween.

20. The improved lamp of claim 19 wherein said contact arm also flexes upon contact with said plate to releasably lock thereto.

* * * * *